United States Patent [19]

Hewitt

[11] 4,338,387

[45] Jul. 6, 1982

[54] OVERCOATED PHOTORECEPTOR CONTAINING INORGANIC ELECTRON TRAPPING AND HOLE TRAPPING LAYERS

[75] Inventor: Harvey J. Hewitt, Williamson, N.Y.

[73] Assignee: Xerox Corporation, Stamford, Conn.

[21] Appl. No.: 239,240

[22] Filed: Mar. 2, 1981

[51] Int. Cl.[3] ..... G03G 5/14

[52] U.S. Cl. ..... 430/58; 430/85; 430/86; 430/95

[58] Field of Search ..... 430/58, 85, 86, 95

[56] References Cited

U.S. PATENT DOCUMENTS

| | | | |
|---|---|---|---|
| 3,312,548 | 4/1967 | Straughan | 430/57 |
| 3,635,705 | 1/1972 | Ciuffini | 430/57 |
| 3,655,377 | 4/1972 | Sechak | 430/57 |
| 4,123,269 | 10/1978 | Vonhoene et al. | 430/60 |

*Primary Examiner*—John D. Welsh
*Attorney, Agent, or Firm*—E. O. Palazzo

[57] ABSTRACT

This invention is generally directed to an inorganic overcoated photoresponsive device comprised of a substrate, a layer of electron trapping material, this layer being comprised of halogen doped selenium, halogen doped arsenic selenium alloys, and mixtures thereof; a hole transport layer in operative contact with the electron trapping layer, this layer being comprised of a halogen doped selenium arsenic alloy wherein the percentage of selenium present by weight is from about 99.5 percent to about 99.9 percent, the percentage of arsenic present by weight is from about 0.5 percent to about 0.1 percent, and the halogen is present in an amount of from 10 parts per million to about 200 parts per million; a charge generating layer overcoated on the hole transport layer, said layer being comprised of alloys of selenium tellurium, or alloys of selenium, tellurium, and arsenic; a hole trapping layer overcoated on the generating layer, said layer being comprised of a halogen doped selenium arsenic alloy wherein the amount of selenium present by weight ranges from about 95 percent to about 99.9 percent, the amount of arsenic present ranges from about 0.1 percent to about 5 percent, and the amount of halogen present ranges from about 10 parts per million to about 200 parts per million; and a layer of insulating organic resin overlaying the hole trapping layer. This device is useful in an electrophotographic imaging system employing a double charging sequence, that is, negative charging followed by positive charging.

9 Claims, 4 Drawing Figures

OVERCOATED PHOTORECEPTOR CONTAINING INORGANIC ELECTRON TRAPPING AND HOLE TRAPPING LAYERS

BACKGROUND OF THE INVENTION

This invention is generally directed to an overcoated photoreceptor device, and more specifically, to an overcoated photoreceptor device containing an electron trapping layer and a hole trapping layer, and a method of imaging utilizing such a device.

The formation and development of images on the imaging surfaces of photoconductive materials by electrostatic means is well known, one of the most widely used processes being xerography as described in U.S. Pat. No. 2,297,691. Numerous different types of photoreceptors can be used in the electrophotographic process, such photoreceptors including inorganic materials, organic materials and mixtures thereof. Photoreceptors are known wherein the charge generation and charge carrier transport functions are accomplished by discrete contiguous layers. Also known are photoreceptors which include an overcoating layer of an electrically insulating polymeric material, and in conjunction with this overcoated type photoreceptor there have been proposed a number of imaging methods. However, the art of electrophotography and more specifically, xerography, continues to advance and more strigent demands need to be met by the copying apparatus in order to increase performance standards, and obtain higher quality images. Also, photoreceptor devices are needed which contain overcoatings that function as a protectent for the photoreceptor.

In one known process using overcoated photoreceptor devices there is employed a non-ambipolar photoconductor wherein charge carriers are injected from the substrate into the photoconductor surface. In such a system in order to obtain high quality images the injecting electrode must satisfy the requirements that it injects carriers efficiently and uniformly into the photoconductor. A method for utilizing organic overcoated photoreceptor devices has been recently discovered and is described in copending application, U.S. Ser. No. 881,262, filed on Feb. 24, 1978 on Electrophotographic Imaging Method, Simpei Tutihasi, Inventor. In the method described in this application, there is utilized an imaging member comprising a substrate, a layer or charge carrier injecting electrode material, a layer of a charge carrier transport material, a layer of a photoconductive charge carrier generating material and an electrically insulating overcoating layer. In one embodiment of operation, the member is charged a first time with electrostatic charges of a first polarity, charged a second time with electrostatic charges of a polarity opposite to the first polarity in order to substantially neutralize the charges residing on the electrically insulating surface of the member and exposed to an imagewise pattern of activating electromagnetic radiation whereby an electrostatic latent image is formed. The electrostatic latent image may then be developed to form a visible image which can be transferred to a receiving member. Subsequently, the imaging member may be reused to form additional reproductions after the erasure and cleaning steps have been accomplished. The actual operation of this member is best illustrated by referring to FIGS. 2A–2C of the present application. While these devices function properly and adequately, there continues to be a need for improved photoreceptor devices which contain a hole trapping layer, and an electron trapping layer, thus allowing for the production of images of high quality over extended periods of time. Also there continues to be a need for overcoated photoreceptors, particularly inorganic overcoated photoreceptors, wherein electrons are trapped at the substrate, and holes or positive charges are trapped at the generating layer overcoating layer interface, which photoreceptor is very efficient and economical to manufacture, and which can be utilized for causing the formation of images in electrophotographic imaging systems.

SUMMARY OF THE INVENTION

It is therefore an object of the present invention to provide an overcoated inorganic photoresponsive device and an imaging method utilizing this device.

A further object of the present invention is to provide an improved inorganic overcoated photoreceptor device containing an electron trapping layer and a hole trapping layer.

A further specific object of the present invention is the provision of an overcoated photoresponsive device which contains an electron hole trapping layer situated between a supporting substrate and a transparent layer, and which device also contains a hole trapping layer situated between a generating layer and a transport overcoating layer.

Another object of the present invention is the provision of an inorganic overcoated photoresponsive device containing a trapping layer, which layer prevents charges from migrating from the interface between the generating layer and the overcoating insulating layer to the substrate, thereby improving image quality, reducing dark decay, as well as improving cyclicability of the photoreceptor device.

Yet an additional object of the present invention is the provision of an inorganic photoresponsive device containing an electron trapping layer, which prevents electrons from migrating from the interface between the substrate and the electron trapping layer to the generating layer, and subsequently to the hole trapping layer.

These and other objects of the present invention are accomplished by providing a layered inorganic photoresponsive device, which can be used in various imaging systems, such as electrophotographic imaging systems, this device being comprised of a substrate, or supporting base, containing on its surface a layer of an electron trapping material comprised of halogen doped selenium, halogen doped selenium alloys, or mixtures thereof, a hole transport layer in operative contact with the electron trapping layer, the transport layer being comprised of a halogen doped selenium arsenic alloy, wherein the percentage by weight of selenium is from about 99.5 percent to about 99.9 percent, the percentage by weight of arsenic is from about 0.1 percent to about 0.5 percent, a charge generating material overcoated on the transport layer, this material being comprised of inorganic photoconductive substances, a halogen doped hole trapping layer overcoated on the generating layer, and as a protective overcoating layer, a layer of insulating organic resin overlaying the hole trapping layer. About 1,000 parts per million to about 4,000 parts per million of halogen are present in the electron trapping layer, and about 10 parts per million to about 200 parts per million of halogen material are present in the transport layer.

In one preferred embodiment of the present invention, the substrate is a conductive material, such as aluminum, the electron trapping layer is a halogen doped selenium material, preferably chlorine doped selenium, containing from about 2,500 parts per million of chlorine to about 3,000 parts per million of chlorine, the hole transport layer is a halogen doped selenium arsenic alloy, wherein the amount of selenium present by weight is 99.9 percent and, the amount of arsenic present by weight is 0.1 percent, and the halogen material, preferably chlorine, is present in an amount of from about 50 parts per million to 100 parts per million, the charge generating layer is an alloy of selenium, and tellurium, or an alloy of selenium, tellurium, and arsenic, the hole trapping layer is a halogen doped selenium arsenic alloy as defined herein, and the overcoating layer is a polyester or polyurethane material.

In one method of operation, the above described layered photoreceptor device is charged a first time with electrostatic charges of a negative charge polarity, subsequently charged a second time with electrostatic charges of a positive polarity for the purpose of substantially neutralizing the charges residing on the electrically insulating surface of the member, followed by exposing the member to an imagewise pattern of activating electromagnetic radiation thereby forming an electrostatic latent image. This image can then be developed to form a visible image which is transferred to a receiving member. The imaging member may be subsequently reused to form additional reproductions after erasure and cleaning. Also, the photoreceptor device of the present invention, containing no overcoating layer, can be used to produce images in well known electrophotographic imaging systems, such as xerographic systems (xerography), as described for example in numerous patents, and literature references.

While various hole trapping layers can be used with the inorganic photoresponsive device of the present invention, including for example, selenium, selenium arsenic alloys, and the like, the trapping layer of the present invention is preferably comprised of a halogen doped selenium arsenic alloy, wherein the percentage by weight of selenium present ranges from about 95 percent to about 99.9 percent, and preferably from about 99 percent to about 99.9 percent, and the percentage by weight of arsenic present ranges from about 0.1 percent to about 5.0 percent, and preferably from about 0.1 percent to about 1 percent, the halogen being present in amounts of from about 10 parts per million to 200 parts per million, and preferably from 20 parts per million to 100 parts per million. By halogen materials is meant fluorine, chlorine, bromine and iodine, with chlorine being preferred. The hole trapping layer composition can be substantially similar to the transport layer, and in some instances both layers can be comprised of the same materials.

The hole trapping layer which is situated between the generating layer and the overcoating insulating layer is of importance since if holes, that is, positive charges, are not substantially retained at the interface between the above two mentioned layers, the efficiency of the photoreceptor device is adversely affected since the holes would migrate back to the other layers in the direction of the substrate. If some of the holes are allowed to migrate, they will, for example, travel towards the electron trapping layer, and eventually neutralize the negative charges located between the substrate and the electron trapping layer, thus reducing the overall voltage useful for succeeding imaging processes. This would adversely affect the imaging system as well as lower the efficiency of the device and render the cyclic characteristics of such a device unstable. It is important to note that the device is operative without the trapping layer, however, depending upon the amount and frequency with which the holes travel through the system, the amount of holes retained at the generator insulator interface varies, resulting in cyclic unstability. The photoresponsive device may remain photosensitive without the trapping layer, however, higher initial fields will be needed in order to render the device efficient. One disadvantage of using higher fields, is that such fields cause breakdown in the system, thus more ozone is generated, which could present an environmental problem in some situations. It is preferable to use lower voltages as this is more efficient, and further with the hole trapping layer, the dark decay of the system, that is, leakage of charges, will improve significantly so as to substantially reduce dark decay.

The thickness of the hole trapping layer ranges from about 0.05 microns to about 5 microns, and preferably from about 0.1 micron to about 1 micron. The minimum thickness of the hole trapping layer may be less, or more, however, it must be of a thickness so as to provide for sufficient trapping of holes at the overcoating interface. The maximum thickness of the hole trapping layer is determined by the amount of light absorption in the trapping layer. Ideally, it is desirable to have substantially all the light absorbed in the highly sensitive generator layer (Se-Te), however, the trapping layer can also absorb much of the light, the amount depending on thickness and the wavelength. As the photogeneration of mobile carriers (holes) is less efficient in the trapping layer than in the generator layer, sensitivity is reduced, accordingly, it is desirable to provide a thin trapping layer, as thin as possible, consistent with efficient trapping of the injected holes migrating from the rear of the structure.

The hole trapping layer can be prepared by many different methods. In one method, there is used a separate crucible within a vacuum coater containing a small quantity of the desired selenium arsenic alloy, whose weight has been previously calibrated to give the desired thickness of trapping layer. Following formation of the generating layer, the alloy is evaporated using a specified time/temperature program. A typical program might involve 5 minutes evaporation during which the crucible temperature is increased from 80° C. to 450° C.

With regard to the electron trapping layer, its primary purpose is to present electrons from migrating into the transport layer which will adversely affect the system in that such electrons will eventually migrate to the generating layer canceling the positive charges contained therein, thereby rendering the overcoated photoresponsive device substantially inoperative in that images will not form on the generating layer. This layer can be prepared by evaporating from a crucible the chlorine doped, (2,800 parts per million of chlorine), selenium from an alloy in shot form as obtained from the alloying process. The crucible temperature is increased from 20° to 350° C. in about 4 minutes, and maintained at 350° C. until evaporation is complete. The transport layer can then be overcoated on the electron trapping layer by numerous known means, including evaporation. Thus, the transport layer, which is comprised of a halogen doped selenium-arsenic alloy is evaporated by current state of the art techniques, in order to result in a layer of the desired thickness, as described hereinafter. The amount of alloy present in the evaporation boats will depend on the specific coater configuration and other process variables, however, the amount is calibrated to yield the desired transport layer thickness. Chamber pressure during evaporation is in the order of less than $4\times10^{-15}$ Torr. Evaporation is completed in 15 to 25 minutes, with the molten alloy temperature ranging from 250° C. to 325° C. Other times and temperatures outside these ranges are also useable as will be understood by those skilled in the art. During deposition of the transport layer, it is desirable that the substrate temperature be maintained in the range of from about 50° C. to about 70° C.

The generating layer can be prepared in one embodiment by grinding the selenium tellurium alloy, and preparing pellets from the grounded material so as to result in a layer of the desired thickness as indicated hereinafter. The pellets are evaporated from crucibles using a time/temperature crucible program designed to minimize the fractionation of the alloy during evaporation. In a typical crucible program, this layer is formed in 12–15 minutes, during which time the crucible temperature is increased from 20° C. to 385° C.

The overcoating layer is deposited on the hole trapping layer, in one embodiment, by known solution spray drying methods.

BRIEF DESCRIPTIONS OF THE DRAWING

For a better understanding of the present invention and further features thereof, reference is made to the following detailed description of various preferred embodiments wherein.

DESCRIPTION OF THE PREFERRED EMBODIMENTS

Figure 1:
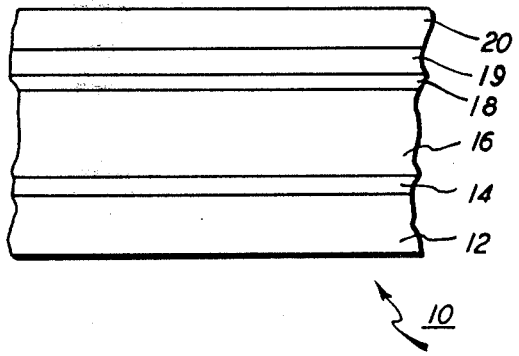
FIG. 1 is a partially schematic cross-sectional view of the layered photoreceptor device of the present invention.

Illustrated in FIG. 1 is the photoresponsive device of the present invention generally designated 10, comprising a substrate 12, overcoated with an electron trapping layer 14, comprised of halogen doped selenium, halogen doped selenium alloys, or mixtures thereof, which in turn is overcoated with a transport layer 16, comprised of a halogen doped selenium arsenic alloy as defined herein, which layer in turn is overcoated with a generating layer 18 comprised of inorganic photoconductive substances, such as alloys of selenium and tellurium, which in turn is overcoated with a hole trapping layer 19, and finally an overcoating layer 20 of an insulating organic resin, such as a polyurethane or a polyester.

The substrate layer 12 may be comprised of a suitable material having the required mechanical properties, while at the same time being capable of injecting electrons and holes, the electrons being trapped at the electron trapping layer, and the holes migrating through the photoreceptor until they are trapped by the hole trapping layer. Illustrative examples of suitable substrates include aluminum, nickel, and the like. The thickness of the substrate layer is dependent upon many factors including economic considerations, design of the machine within which the photoresponsive devices are to be used, and the like. Thus, this layer may be of substantial thickness, for example, up to 200 mils, or of minimum thickness, that is, approximately 5 mils. Generally however, the thickness of this layer ranges from about 5 mils to about 200 mils. The substrate can be flexible or rigid and may have different configurations such as for example, a plate, a cylindrical drum, a scroll or an endless flexible belt, and the like.

The electron trapping layer 14 is comprised of halogen doped selenium, halogen doped selenium alloys or mixtures thereof. The amount of halogen present ranges from about 1,000 parts per million to about 4,000 parts per million, and preferably from about 2,500 parts per million to about 3,000 parts per million. The preferred halogen is chlorine. Alloys of selenium that can be employed include selenium arsenic, selenium tellurium, selenium arsenic tellurium, selenium arsenic antimony and the like. The preferred selenium alloy is arsenic selenium wherein the percentage by weight of arsenic is about 0.1 percent and the percentage by weight of selenium is about 99.1 percent. This layer ranges in thickness of from about 1 micron to about 5 microns, and preferably from about 2 microns to about 3 microns.

The transport layer 16 is comprised of a halogen doped selenium arsenic alloy, however, an undoped alloy may also be used. The percent of selenium present in the alloy ranges from about 99.5 percent to about 99.9 percent, and the percentage of arsenic present ranges from about 0.1 percent to about 0.5 percent. The amount of halogen, chlorine, fluorine, iodine, or bromine present ranges from about 10 parts per million to about 200 parts per million, with the preferred range being from 50 parts per million to 100 parts per million. The preferred halogen is chlorine. This layer generally ranges in thickness of from about 20 to about 60 microns, and preferably from about 25 microns to about 50 microns.

The generating layer 18 is comprised of inorganic photoconductive materials such as alloys of selenium and tellurium; and selenium, tellurium and arsenic. With regard to the selenium, tellurium, arsenic alloy, the percentage of selenium present ranges from about 70 percent to about 90 percent, the percentage of tellurium present ranges from about 10 percent to about 30 percent, and the percentage of arsenic present ranges from about 2 percent to about 10 percent; subject to the provision that the total percentage of the three ingredients totals 100 percent. This alloy preferably contains about 75 percent of selenium by weight, 21 percent of tellurium by weight, and 4 percent of arsenic by weight. The selenium tellurium alloy contains about 75 percent to about 90 percent by weight of selenium, and from about 10 percent to about 25 percent by weight of tellurium. This layer ranges in thickness of from about 0.1 micron to about 5 microns, and preferably from 0.2 to about 1 micron. The generating layer generally is of a thickness which is sufficient to absorb at least 90 percent or more of the incident radiation which is directed upon it in the imagewise exposure step.

The hole trapping layer 19 can be comprised of various inorganic materials, such as selenium, selenium alloys including arsenic selenium, arsenic sulfur selenium, however, this layer is preferably comprised of a halogen doped selenium arsenic alloy as described hereinbefore, layer 19, ranging in thickness of from about 0.05 microns to about 5 microns, and preferably from about 0.1 micron to about 1 micron.

The electrically insulating overcoating layer 20 is generally from about 5 to about 25 microns in thickness, and preferably from about 12 to about 18 microns in thickness. The minimum thickness of this layer is determined by the function the layer must provide, whereas the maximum thickness is determined by mechanical considerations and the resolution capability desired for the photoresponsive device. Generally, this layer provides a protective function in that for example, the generating layer is not contacted with toner, and ozone which is generated during the imaging cycles. The overcoating layer also prevents corona charges from penetrating through it into the charge generating layer 18, or from being injected into it by the latter. Preferably, therefore, layer 20 comprises materials having high resistance to charge carrier injection. Typical suitable overcoating materials include polyethylenes, polycarbonates, polystyrenes, polyesters, polyurethanes, and the like, with polyurethanes commercially available from Mobil Corporation or Kansai Paint Company, and polyesters commercially available from Goodyear Chemical Company being the preferred overcoating layer. The formation of the insulating layer over the charge generating layer may be accomplished by any one of several methods known in the art such as spraying, dipping, roll coating and the like.

Figure 2A:
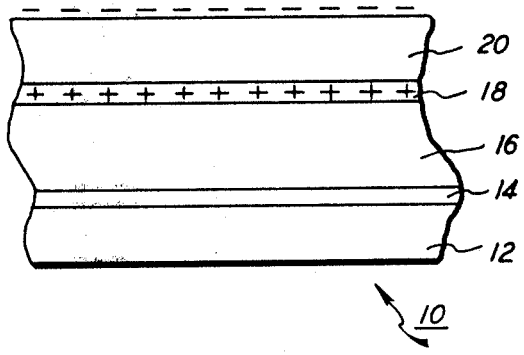
FIGS. 2A to 2C illustrate the imaging steps employed with the photoreceptor device of the present invention.
Figure 2B:
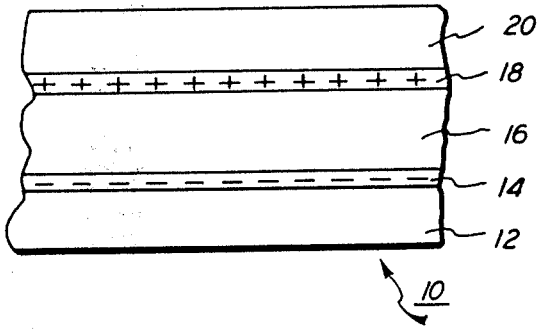
Figure 2C:
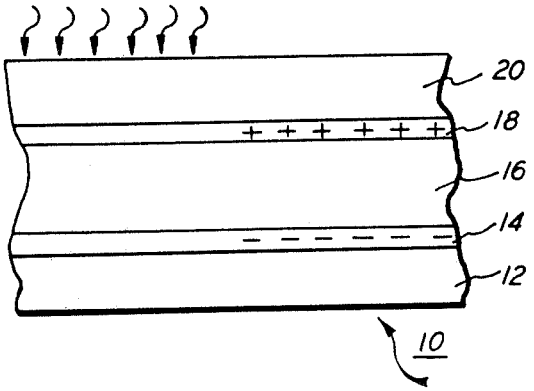

The operation of the member of the present invention is illustrated in FIGS. 2A–2C. In this illustrative explanation the initial charging step is carried out with negative polarity, however, the method is not necessarily limited to this embodiment. Moreover, the description of the method will be given in conjunction with a proposed theoretical mechanism, by which the method is thought to be operative, in order to better aid those skilled in the art to understand and practice the invention. It should be noted however, that the method has been proven to be operable and highly effective through actual experimentation and any inaccuracy in the proposed theoretical mechanism of operation is not to be construed as being limiting of the invention.

Referring to FIG. 2A, there is seen the condition of the photoresponsive device after it has been electrically charged negatively a first time, uniformly across its surface in the absence of illumination, by any suitable electrostatic charging apparatus such as a corotron. The negative charges reside on the surface of electrically insulating layer 20. As a consequence of the charging an electrical field is established across the photoreceptor, and as a consequence of the electrical field and the work function relationship between layers 14 and 16, holes are injected from the substrate into the charge carrier transport layer. The holes injected into the charge carrier transport layer are transported through the layer, enter into the charge carrier generating layer 18 and travel through the latter until they reach the interface between the charge carrier generating layer 18 and the electrically insulating layer 20, where they become trapped, by trapping layer 19. The charges thus trapped at the interface establish an electrical field across the electrically insulating layer 20.

Subsequently, the member is charged a second time, again in the absence of illumination, with a polarity opposite to that used in the first charging step in order to substantially neutralize the charges residing on the surface of the member. In this illustrative instance, the second charging of the member is with positive polarity. After the second charging step, the surface of the photoresponsive device should be substantially free of electrical charges. The substantially neutralized surface is created by selecting a charging voltage, such that the same number of positive charges are deposited as negative charges previously deposited. By "substantially neutralized" within the context of this invention is meant that the voltage across the photoreceptor member, upon illumination of the photoreceptor, is substantially zero.

FIG. 2B illustrates the condition of the photoreceptor after the second charging step. In this illustration, no charges are shown on the surface of the member. The positive charges residing at the interface of layers 18 and 20 as a result of the first charging step remain trapped in layer 19, not shown in FIG. 2B, at the end of the second charging step. However, there is now a uniform layer of negative charges located at the interface between layers 14 and 16.

Therefore the net result of the second charging step is to establish a uniform electrical field across the charge carrier transport and charge carrier generating layers. To achieve this result, it is critical that the negative charges be located in the electron trapping layer 14, and that such charges be prevented from entering into and being transported through the transport layer.

Subsequently, reference FIG. 2C, the member is exposed to an imagewise pattern of electromagnetic radiation to which the charge carrier generating material comprising layer 18 is responsive. The exposure of the member may be affected through the electrically insulating overcoating. As a result of the imagewise exposure an electrostatic latent image is formed in the device. This is because hole electron pairs are generated in the light struck areas of the charge carrier generating layer. The light generated holes are injected into the charge carrier transport layer and travel through it to be neutralized by the negative charges. The light generated electrons neutralize the positive charges trapped at the interface between layers 18 and 20. In the areas of the member which did not receive any illumination, the positive charges remain in their original position. Thus, there continues to be an electrical field across the charge carrier transport and charge carrier generating layers in areas which do not receive any illumination, whereas the electrical field across the same layers in the areas which receive illumination is discharged to some low level (FIG. 2C).

The electrostatic latent image formed in the member may be developed to form a visible image by any of the well known xerographic development techniques, for example, cascade, magnetic brush, liquid development and the like. The visible image is typically transferred to a receiver member by any conventional transfer technique and affixed to a receiver member by any conventional transfer technique and affixed thereto. While it is preferable to develop the electrostatic latent image with toner, the image may be used in a host of other ways such as, for example, "reading" the latent image with an electrostatic scanning system.

When the photoresponsive device of the present invention is to be reused to make additional reproductions, as in a recyclable xerographic apparatus, any residual charge remaining on the device after the visible image has been transferred to a receiver member typically is removed therefrom prior to each repetition of the cycle as is any residual toner material remaining after the transfer step. Generally, the residual charge can be removed from the photoreceptor by ionizing the air above the electrically insulating overcoating of the photoreceptor, while the photoconductive carrier generating layer is uniformly ulluminated and grounded.

For example, charge removal can be affected by AC corona discharge in the presence of illumination from a light source, or preferably a grounded conductive brush could be brought into contact with the surface of the photoreceptor in the presence of such illumination. This latter mode also will remove any residual toner particles remaining on the surface of the photoreceptor.

The invention will now be described in detail with respect to specific preferred embodiments thereof, it being understood that these examples are intended to be illustrative only and the invention is not intended to be limited to the materials, conditions, process parameters and the like recited herein. All parts and percentages are by weight unless otherwise indicated.

EXAMPLE I

There was prepared an overcoated inorganic photoresponsive device by evaporating at a temperature up to about 300° C. from a Tungston crucible onto an aluminum substrate, having a thickness of 7,500 microns, 3 parts by weight of a chlorine doped amorphous selenium material containing 2,850 parts per million of chlorine resulting in an electron trapping layer contained on the aluminum substrate, this layer being present in a thickness of three microns. There was then deposited on the electron trapping layer by evaporation at a temperature of 325° C., on the electron trapping layer, a hole transport layer, 40 microns in thickness and consisting of a chlorine doped selenium arsenic alloy, containing 99.6 percent by weight of selenium, 0.3 percent by weight of arsenic, and 20 parts per million of chlorine. Subsequently, there was deposited by evaporation up to about 325° C. of pellets of a selenium arsenic alloy on the hole transport layer a generating layer, one micron in thickness, consisting of a selenium tellurium arsenic alloy, containing 75 percent by weight of selenium, 21 percent by weight of tellurium, and 4 percent by weight of arsenic.

There was then applied by evaporation at about 390° C. over the generating layer a hole trapping layer comprised of a chlorine doped selenium arsenic alloy, containing 99.6 percent selenium, 0.3 percent arsenic and 20 parts per million of chlorine. The resulting hole trapping layer had a thickness of 0.1 microns.

There was then deposited by solution coating over the trapping layer an overcoating insulating layer, 18 microns in thickness, consisting of Vitel, a polyester resin commercially available from Goodyear Chemical Company.

There thus results a layered inorganic photoresponsive device comprised of an aluminum substrate, overcoated with an electron trapping layer, which in turn is overcoated with a transport layer, followed by an overcoating of a generating layer, followed by an overcoating of a hole trapping layer and finally a top overcoating layer of the polyester resin.

The above overcoated photoreceptor device when used in an imaging system employing double charging, that is, charging with uniform negative charges followed by charging with an equal number of positive charges resulted in images of high quality and excellent resolution after development with a toner composition and transfer to a paper substrate. The specific imaging steps employed with the photoresponsive device of this Example are detailed hereinbefore with reference to FIGS. 2A–2C.

EXAMPLE II

The procedure of Example I was repeated with the exception that a cylindrical aluminum tube, approximately 4 inches in diameter by 16 inches long was used as a substrate, the electron trapping material was comprised of a chlorine doped amorphous selenium material containing 2,500 parts per million of chlorine. The transport material was comprised of an alloy consisting of 99.8 percent by weight of selenium, 0.2 percent by weight of arsenic, and 30 parts per million of chlorine, the generating layer was comprised of 75 percent by weight of selenium, and 25 percent by weight of arsenic, and the overcoating layer was a polyurethane material commercially available from Allied Chemical Company.

The above overcoated photoreceptor device when used in an imaging system employing double charging, that is, charging with uniform negative charges followed by charging with an equal number of positive charges resulted in images of high quality and excellent resolution after development with a toner composition and transfer to a paper substrate. The specific imaging steps employed with the photoresponsive device of this Example are detailed hereinbefore with reference to FIGS. 2A–2C.

EXAMPLE III

The procedure of Example I was repeated with the exception that a hole trapping layer, 0.1 microns in thickness, was comprised of an alloy of selenium and arsenic, selenium being present in an amount of 99.9 percent by weight, arsenic being present in an amount 0.1 percent by weight, which alloy was doped with 20 parts per million of chlorine.

The above overcoated photoreceptor device when used in an imaging system employing double charging, that is, charging with uniform negative charges followed by charging with an equal number of positive charges resulted in images of high quality and excellent resolution after development with a toner composition and transfer to a paper substrate. The specific imaging steps employed with the photoresponsive device of this Example are detailed hereinbefore with reference to FIGS. 2A–2C.

EXAMPLE IV

The procedure of Example I was repeated with the exception that the photoreceptor device prepared contained an electron trapping layer having a thickness of 2 microns, a transport layer having a thickness of 35 microns, and a generating layer having a thickness of 0.1 microns.

The above overcoated photoreceptor device when used in an imaging system employing double charging, that is, charging with uniform negative charges followed by charging with an equal number of positive charges resulted in images of high quality and excellent resolution after development with a toner composition and transfer to a paper substrate. The specific imaging steps employed with the photoresponsive device of this Example are detailed hereinbefore with reference to FIGS. 2A–2C.

Although this invention has been described with respect to certain preferred embodiments, it is not intended to be limited thereto rather, those skilled in the art will recognize that variations and modifications may be made therein which are within the spirit of the invention and the scope of the claims.

What is claimed is:

1. A layered inorganic photoresponsive device which comprises (a) a substrate;

(b) a layer of electron trapping material, this layer being comprised of halogen doped selenium, halogen doped arsenic selenium alloys, and mixtures thereof;

(c) a hole transport layer in operative contact with the electron trapping layer, this layer being comprised of a halogen doped selenium arsenic alloy wherein the percentage of selenium present by weight is from about 99.5 percent to about 99.9 percent, the percentage of arsenic present by weight is from about 0.5 percent to about 0.1 percent, and the halogen is present in an amount of from 10 parts per million to about 200 parts per million;

(d) a charge generating layer overcoated on the hole transport layer; said layer being comprised of alloys of selenium-tellurium, or alloys of selenium, tellurium, and arsenic, (e) a hole trapping layer overcoated on the generating layer, said layer being comprised of a halogen doped selenium arsenic alloy wherein the amount of selenium present by weight ranges from about 95 percent to about 99.9 percent, the amount of arsenic present ranges from about 0.1 percent to about 5 percent, and the amount of halogen present ranges from about 10 parts per million to about 200 parts per million; and (f) a layer of insulating organic resin overlaying the hole trapping layer.

2. A layered inorganic photoresponsive device in accordance with claim 1 wherein the substrate is conductive, the electron trapping layer is a chlorine doped selenium material with the amount of chlorine present ranging from about 1,000 parts per million, to about 4,000 parts per million, the charge generating layer is comprised of a selenium tellurium alloy, containing 75 percent selenium, and 25 percent arsenic, the hole trapping layer is comprised of a chlorine doped selenium arsenic alloy wherein the amount of selenium present by weight is 99.9 percent, the amount of arsenic present by weight is 0.1 percent, and from about 50 parts per million to about 100 parts per million of chlorine, and the insulating organic resin overcoating is a polyester material.

3. A layered photoresponsive device in accordance with claim 1 wherein the electron trapping layer is an arsenic selenium alloy doped with chlorine, the amount of arsenic present being 0.1 percent, the amount of selenium present being 99.9 percent, with 2,000 parts per million of chlorine being present, and the generating material is comprised of a selenium tellurium arsenic alloy.

4. A layered photosensitive device in accordance with claim 3 wherein the generating material is comprised of 75 percent by weight of selenium, 21 percent by weight of tellurium, and 4 percent by weight of arsenic.

5. A layered inorganic photoresponsive device in accordance with claim 1 wherein the thickness of the substrate layer ranges from about 5 mils to about 200 mils, the thickness of the electron trapping layer ranges from about 1 micron to about 5 microns, the thickness of the hole transport layer ranges from about 20 microns to about 60 microns, the thickness of the charge generating layer is from about 0.1 micron to about 5 microns, the thickness of the hole trapping layer is from about 0.05 micron to about 5 microns, and the insulating organic resin overcoating layer has a thickness of from about 5 microns to about 25 microns.

6. An electrophotographic imaging method comprising providing a photoresponsive inorganic overcoating device of claim 1, charging the device with negative electrostatic charges, followed by charging the device with positive electrostatic charges in order to substantially neutralize the negative charges residing on the surface of the device, exposing the device to an imagewise pattern of electromagnetic radiation to which the charge carrier generating material is responsive whereby there is formed an electrostatic latent image on the photoresponsive device, and optionally transferring the electrostatic latent image to a permanent substrate subsequent to its development with toner.

7. An electrophotographic imaging method in accordance with claim 6 wherein the substrate is aluminum, the electron trapping layer is a chlorine doped selenium material with the amount of chlorine present ranging from about 1,000 parts per million to about 4,000 parts per million, the charge generating layer is comprised of a selenium tellurium alloy, containing 75 percent selenium and 25 percent arsenic, the hole trapping layer is comprised of a halogen doped selenium arsenic alloy wherein the amount of selenium present by weight is 99.9 percent, the amount of arsenic present by weight is 0.1 percent, and from about 50 parts per million to about 100 parts per million of chlorine, and the insulating organic overcoating material is a polyester resin.

8. An electrophotographic imaging method in accordance with claim 6 wherein the generating layer is a selenium tellurium arsenic alloy, containing 75 percent by weight of selenium, 21 percent by weight of tellurium and 4 percent by weight of arsenic.

9. An electrophotographic imaging method in accordance with claim 6 wherein the thickness of the substrate layer ranges from about 5 mils to about 200 mils, the thickness of the electron trapping layer ranges from about 1 micron to about 5 microns, the thickness of the hole transport layer ranges from about 20 microns to about 60 microns, the thickness of the charge generating layer is from about 0.05 micron to about 5 microns, the thickness of the hole trapping layer is from about 0.01 micron to about 5 microns, and the insulating organic resin overcoating layer has a thickness of from about 5 microns to about 25 microns.

* * * * *